United States Patent [19]

Breckenfeld et al.

[11] Patent Number: 4,993,369

[45] Date of Patent: Feb. 19, 1991

[54] INTERNAL COMBUSTION ENGINE

[75] Inventors: Paul W. Breckenfeld, Kenosha, Wis.; George L. Broughton, Zion; Duane W. Forquer, Waukegan, both of Ill.

[73] Assignee: Outboard Marine Corporation, Waukegan, Ill.

[21] Appl. No.: 526,065

[22] Filed: May 18, 1990

Related U.S. Application Data

[63] Continuation-in-part of Ser. No. 316,153, Feb. 27, 1989, abandoned.

[51] Int. Cl.[5] ..... F02B 75/18; F02B 33/04

[52] U.S. Cl. ..... 123/52 MV; 123/73 A

[58] Field of Search ..... 123/52 MV, 65 R, 73 A, 123/73 B, 73 C, 73 R, 195 C, 198 E

[56] References Cited

U.S. PATENT DOCUMENTS

| | | | |
|---|---|---|---|
| 2,209,301 | 7/1940 | Johnson et al. | 115/18 |
| 2,224,900 | 12/1940 | Conover | 115/18 |
| 2,227,247 | 12/1940 | Conover | 123/173 |
| 2,334,916 | 11/1943 | Ford et al. | 308/23 |
| 2,460,419 | 2/1949 | Kincannon | 115/17 |
| 2,501,470 | 3/1950 | Krueger et al. | 115/17 |
| 2,549,478 | 4/1951 | Kiekhaefer | 123/73 |
| 2,631,799 | 3/1953 | Poulin | 248/4 |
| 2,684,635 | 7/1954 | Winkelman et al. | 103/113 |
| 2,718,792 | 9/1955 | Kiekhaefer | 74/378 |
| 2,737,143 | 3/1956 | Moran | 115/18 |
| 2,757,888 | 8/1956 | Branstrator | 248/4 |
| 2,911,937 | 11/1959 | Kiekhaefer | 115/17 |
| 2,983,554 | 5/1961 | Caris et al. | 308/23 |
| 3,090,463 | 5/1963 | Yanda | 181/33 |
| 3,148,557 | 9/1964 | Shimanckas | 74/378 |
| 3,153,397 | 10/1964 | Mattson et al. | 115/17 |
| 3,464,746 | 9/1969 | Weber | 308/23 |
| 3,851,631 | 12/1974 | Kiekhaefer | 123/73 R |
| 4,101,003 | 7/1978 | Timour et al. | 123/195 C |
| 4,177,747 | 12/1979 | Pichl | 115/41 HT |
| 4,185,598 | 1/1980 | Onishi | 123/73 |
| 4,266,514 | 5/1981 | Tyner | 123/73 R |
| 4,333,425 | 6/1982 | Kusche | 123/73 C |
| 4,368,698 | 11/1983 | Matsuo et al. | 123/52 |
| 4,378,763 | 4/1983 | Ishihama | 123/196 R |
| 4,474,145 | 10/1984 | Boyesen | 123/73 A |
| 4,520,770 | 6/1985 | Ogawa | 123/195 |
| 4,520,771 | 6/1985 | Hayashi | 123/195 H |
| 4,559,018 | 12/1985 | Nakahama et al. | 440/77 |
| 4,583,953 | 4/1986 | Nakase | 440/52 |
| 4,598,673 | 7/1986 | Poehlman | 123/73 C |
| 4,615,683 | 10/1986 | Harada et al. | 440/52 |
| 4,621,595 | 11/1986 | Suzuki | 123/41.72 |
| 4,632,662 | 12/1986 | Handa | 440/52 |
| 4,651,691 | 3/1987 | Ogawa | 123/195 H |
| 4,698,037 | 10/1987 | Watanabe et al. | 440/78 |
| 4,702,202 | 10/1987 | Hensel et al. | 123/73 A |
| 4,711,201 | 12/1987 | Ooyama et al. | 123/73 A |
| 4,726,795 | 2/1988 | Uehara | 440/52 |
| 4,726,799 | 2/1988 | Harada et al. | 440/76 |
| 4,735,589 | 4/1988 | Irwin et al. | 440/87 |
| 4,747,795 | 5/1988 | Kawamura et al. | 440/75 |
| 4,773,366 | 9/1988 | Seidl et al. | 123/195 C |
| 4,777,913 | 10/1988 | Staerzl et al. | 123/73 A |
| 4,781,635 | 11/1988 | Kinouchi et al. | 440/75 |
| 4,784,090 | 11/1988 | Sougawa | 123/52 MV |
| 4,810,218 | 3/1989 | Iwai | 440/66 |
| 4,863,405 | 9/1989 | Hervat et al. | 440/53 |

FOREIGN PATENT DOCUMENTS

| | | | |
|---|---|---|---|
| 450273 | 2/1949 | Italy | 123/73 A |

*Primary Examiner*—Charles J. Myhre
*Assistant Examiner*—Weilun Lo
*Attorney, Agent, or Firm*—Michael, Best & Friedrich

[57] ABSTRACT

A two-stroke internal combustion engine comprising an engine block including a first exterior surface portion, a second exterior surface portion spaced from the first portion and having therein a crankcase-defining cavity, and a combustion air passage extending from the first exterior surface portion to the crankcase-defining cavity, an intake manifold fixed to the first exterior surface portion of the engine block and including therein a combustion air passage in alignment with the combustion air passage in the engine block, and a carburetor fixed to the intake manifold and having therein a combustion air passage in alignment with the intake manifold combustion air passage.

20 Claims, 4 Drawing Sheets

4
4
17
15

11
41
93

17
15
19

19
11
19
19
19
19

INTERNAL COMBUSTION ENGINE

This is a continuation-in-part of U.S. Ser. No. 316,153, filed Feb. 27, 1989 and now abandoned.

BACKGROUND OF THE INVENTION

The invention relates generally to two-stroke internal combustion engines of one or more cylinders, wherein each cylinder has associated therewith a separate crankcase defined in part by an engine block member, a crankcase cover member, and a crankshaft.

The invention also relates to arrangements for feeding combustion air to the separate crankcases. More particularly, the invention also relates to the location of the mounting on the engine of the intake manifolds and associated carburetors.

In addition, the invention relates to arrangements for rotatably supporting the crankshaft relative to the engine block and to arrangements for completing the separate crankcases.

Attention is directed to the following U.S. Pat. Nos.:

| | | |
|---|---|---|
| Conover | 2,224,900 | June 6, 1938 |
| Conover | 2,227,247 | Dec. 4, 1939 |
| Ford, et al. | 2,334,916 | May 4, 1942 |
| Kiekhaefer | 2,549,478 | Sept. 5, 1947 |
| Caris, et al. | 2,983,554 | May 9, 1961 |
| Weber | 3,464,746 | June 16, 1967 |
| Onishi | 4,185,598 | Jan. 29, 1980 |
| Matsuo, et al. | 4,368,698 | Jan. 18, 1983 |
| Ogawa | 4,520,770 | June 4, 1985 |
| Hayashi | 4,520,771 | June 4, 1985 |
| Ogawa | 4,651,691 | March 24, 1987 |

SUMMARY OF THE INVENTION

The invention provides a two-stroke internal combustion engine comprising an engine block including an exterior planar surface portion having therein a pair of spaced bearing surfaces and a crankcase-defining cavity which includes a pair of spaced semi-cylindrical surfaces, a crankshaft including a pair of spaced bearing portions and a central part which is located between the bearing portions and which includes a pair of spaced and enlarged cylindrical surfaces, a pair of bearing blocks respectively including bearing surfaces, means fixing the bearing blocks to the exterior planar surface portion with each of the crankshaft bearing portions retained between a respective one of the bearing surfaces of the engine block and a respective one of the bearing surfaces of the bearing blocks and with each of the crankshaft cylindrical surfaces in coplanar relation to a respective one of the semi-cylindrical surfaces of the engine block, a crankcase cover including a mounting surface having therein a crankcase-defining cavity including a pair of spaced semi-cylindrical surfaces, and means fixedly connecting the mounting surface of the crankcase cover to the exterior planar surface portion of the engine block with each of the semi-cylindrical surfaces of the crankcase cover in generally coplanar relation to a respective one of the semi-cylindrical surfaces of the engine block.

The invention also provides a two-stroke internal combustion engine comprising an engine block including a first exterior surface portion, a second exterior surface portion spaced from the first portion, extending in coplanar relation to the first exterior surface portion, and having therein a crankcase-defining cavity, a cylinder communicating with the crankcase-defining cavity, and a combustion air passage extending from the first exterior surface portion to the crankcase-defining cavity, and means connected to the first exterior surface portion for supplying combustion air to the combustion air passage.

The invention also provides a two-stroke internal combustion engine comprising an engine block including a first exterior surface portion, a second exterior surface portion spaced from the first portion and having therein a pair of spaced bearing surfaces and a crankcase-defining cavity which includes a pair of spaced semi-cylindrical surfaces, and a combustion air passage extending from the first exterior surface portion to the crankcase-defining cavity, a crankshaft including a pair of spaced bearing portions and a central part located between the bearing portions and including a pair of spaced and enlarged cylindrical surfaces, a pair of bearing blocks respectively including bearing surfaces, means fixing the bearing blocks to the second exterior surface portion with each of the crankshaft bearing portions retained between a respective one of the bearing surfaces of the engine block and a respective one of the bearing surfaces of the bearing blocks and with each of the enlarged crankshaft cylindrical surfaces in coplanar relation to a respective one of the semi cylindrical surfaces of the engine block, a crankcase cover including a mounting surface having therein a crankcase-defining cavity including a pair of spaced semi-cylindrical surfaces, means fixedly connecting the mounting surface of the crankcase cover to the second exterior surface portion of the engine block with each of the semi-cylindrical surfaces thereof in generally coplanar relation to a respective one of the semi-cylindrical surfaces of the engine block and so as to cover the bearing blocks and the central part of the crankshaft, and means connected to the first exterior surface portion for supplying combustion air to the combustion air passage.

The invention also provides a two-stroke internal combustion engine comprising a V-type engine block including spaced first and second exterior surface portions, a third exterior surface portion which is located between the first and second surface portions and which has therein a plurality of first crankcase-defining cavities and a plurality of second crankcase-defining cavities, a first cylinder bank including a plurality of first cylinders each communicating with a respective one of the first crankcase-defining cavities, a second cylinder bank which is angularly spaced from the first cylinder bank and which includes a plurality of second cylinders each communicating with a respective one of the second crankcase-defining cavities, a plurality of first combustion air passages each extending from the first exterior surface portion to a respective one of the first crankcase-defining cavities, and a plurality of second combustion air passages each extending from the second exterior surface portion to a respective one of the second crankcase-defining cavities, and means connected to the first and second exterior surface portions for supplying combustion air to the first and second combustion air passages.

The invention also provides a two-stroke internal combustion engine comprising a V-type engine block including an exterior surface having spaced first and second exterior surface portions and a third exterior surface portion which is planar and which is located between the first and second surface portions and which has therein a pair of spaced bearing surfaces, a plurality of first crankcase-defining cavities located between the spaced bearing surfaces and each including a pair of spaced semi-cylindrical surfaces, and a plurality of second crankcase-defining cavities located between the spaced bearing surfaces and each including a pair of spaced semi-cylindrical surfaces, a first cylinder bank including a plurality of first cylinders each communicating with a respective one of the first crankcase-defining cavities, a second cylinder bank which is angularly spaced from the first cylinder bank and which includes a plurality of second cylinders each communicating with a respective one of the second crankcase-defining cavities, a crankshaft including a pair of spaced bearing portions and a plurality of central parts which are located between the bearing portions and each of which includes a pair of spaced and enlarged cylindrical surfaces, a pair of bearing blocks respectively including bearing surfaces, means fixing the bearing blocks to the third exterior surface portion of the engine block with each of the crankshaft bearing portions retained between a respective one of the bearing surfaces of the engine block and a respective one of the bearing surfaces of the bearing blocks and with each of the crankshaft cylindrical surfaces in coplanar relation to a respective one of the semi-cylindrical surfaces of the engine block, a crankcase cover including a mounting surface having therein a plurality of crankcase-defining cavities each including a pair of spaced semi-cylindrical surfaces, and means fixedly connecting the mounting surface of the crankcase cover to the third exterior surface portion of the engine block with each of the semi-cylindrical surfaces of the crankcase cover in generally coplanar relation to a respective one of the semi-cylindrical surfaces of the engine block.

The invention also provides a two-stroke internal combustion engine comprising a V-type engine block including an exterior surface having spaced first and second exterior surface portions and a third exterior surface portion which is located between the first and second surface portions and which has therein first and second crankcase-defining cavities, a first cylinder bank including a first cylinder communicating with the first crankcase-defining cavity, a second cylinder bank which is angularly spaced from the first cylinder bank and which includes a second cylinder communicating with the second crankcase-defining cavity, a first combustion air passage extending from the first exterior surface portion for supplying combustion air to the first cylinder, means connected to the first exterior surface portion for supplying combustion air to the first combustion air passage, a second combustion air passage extending from the second exterior surface portion for supplying combustion air to the second cylinder, and means connected to the second exterior surface portion for supplying combustion air to the second combustion air passage.

The invention also provides a two-stroke internal combustion engine comprising a V-type engine block including an exterior surface having spaced first and second exterior surface portions and a third exterior surface portion having therein first and second crankcase-defining cavities, a first cylinder bank including a first cylinder communicating with the first crankcase-defining cavity, a second cylinder bank which is angularly spaced from the first cylinder bank and which includes a second cylinder communicating with the second crankcase-defining cavity, a first combustion air passage extending from the first exterior surface portion for supplying combustion air to the first cylinder, means connected to the first exterior surface portion for supplying combustion air to the first combustion air passage, a second combustion air passage extending from the second exterior surface portion for supplying combustion air to the second cylinder, means connected to the second exterior surface portion for supplying combustion air to the second combustion air passage, and a crankcase cover including a rearward part which is mounted on the third surface portion of the engine block and which has therein first and second crankcase-defining cavities respectively aligned with the first and second crankcase-defining cavities in the third surface portion of the engine block, and a forward part located forwardly of the first and second surface portions of the engine block.

The invention also provides an internal combustion engine comprising a V-type engine block including an exterior surface having spaced first and second exterior surface portions and a third exterior surface portion which is located between the first and second surface portions and which has therein a crankcase-defining cavity, a first cylinder bank including a first cylinder, a second cylinder bank which is angularly spaced from the first cylinder bank and which includes a second cylinder, a first combustion air passage extending from the first exterior surface portion for supplying combustion air to the first cylinder, means connected to the first exterior surface portion for supplying combustion air to the first combustion air passage, a second combustion air passage extending from the second exterior surface portion for supplying combustion air to the second cylinder, and means connected to the second exterior surface portion for supplying combustion air to the second combustion air passage.

The invention also provides an internal combustion engine comprising a V-type engine block including an exterior surface having spaced first and second exterior surface portions and a third exterior surface portion having therein a crankcase-defining cavity, a first cylinder bank including a first cylinder, a second cylinder bank which is angularly spaced from the first cylinder bank and which includes a second cylinder, a first combustion air passage extending from the first exterior surface portion for supplying combustion air to the first cylinder, means connected to the first exterior surface portion for supplying combustion air to the first combustion air passage, a second combustion air passage extending from the second exterior surface portion for supplying combustion air to the second cylinder, means connected to the second exterior surface portion for supplying combustion air to the second combustion air passage, and a crankcase cover including a rearward part which is mounted on the third surface portion of the engine block and which has therein a crankcase-defining cavity aligned with the crankcase-defining cavity in the third surface portion of the engine block, and a forward part located forwardly of the first and second surface portions of the engine block.

Other features and advantages of the invention will become apparent to those skilled in the art upon review of the following detailed description, claims, and drawings.

THE DRAWINGS

Figure 1:
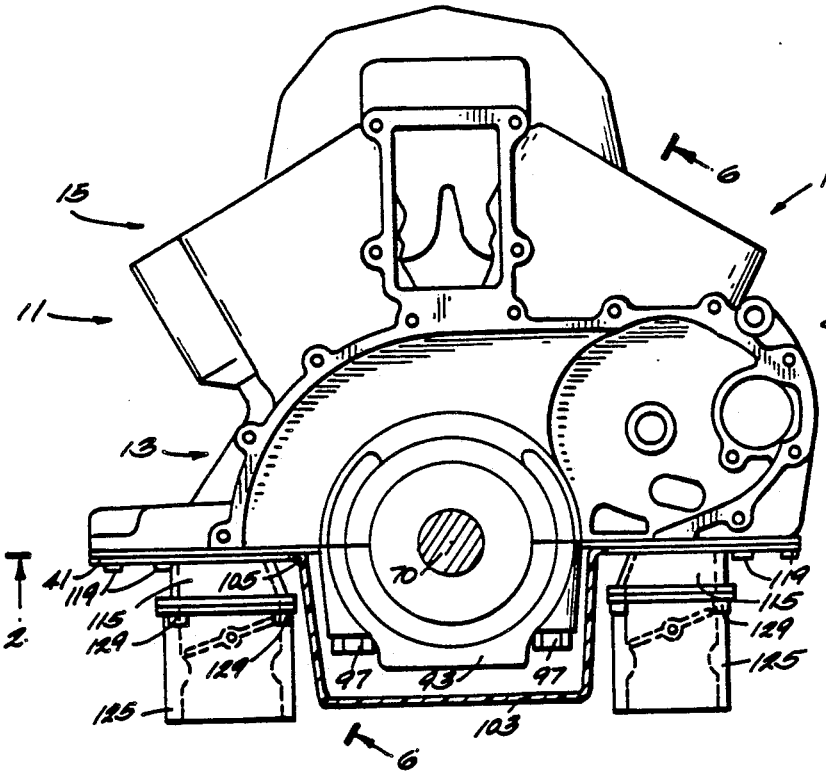
FIG. 1 is a top plan view, partially in section, of an internal combustion engine embodying the invention and including an engine block.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Figure 4:
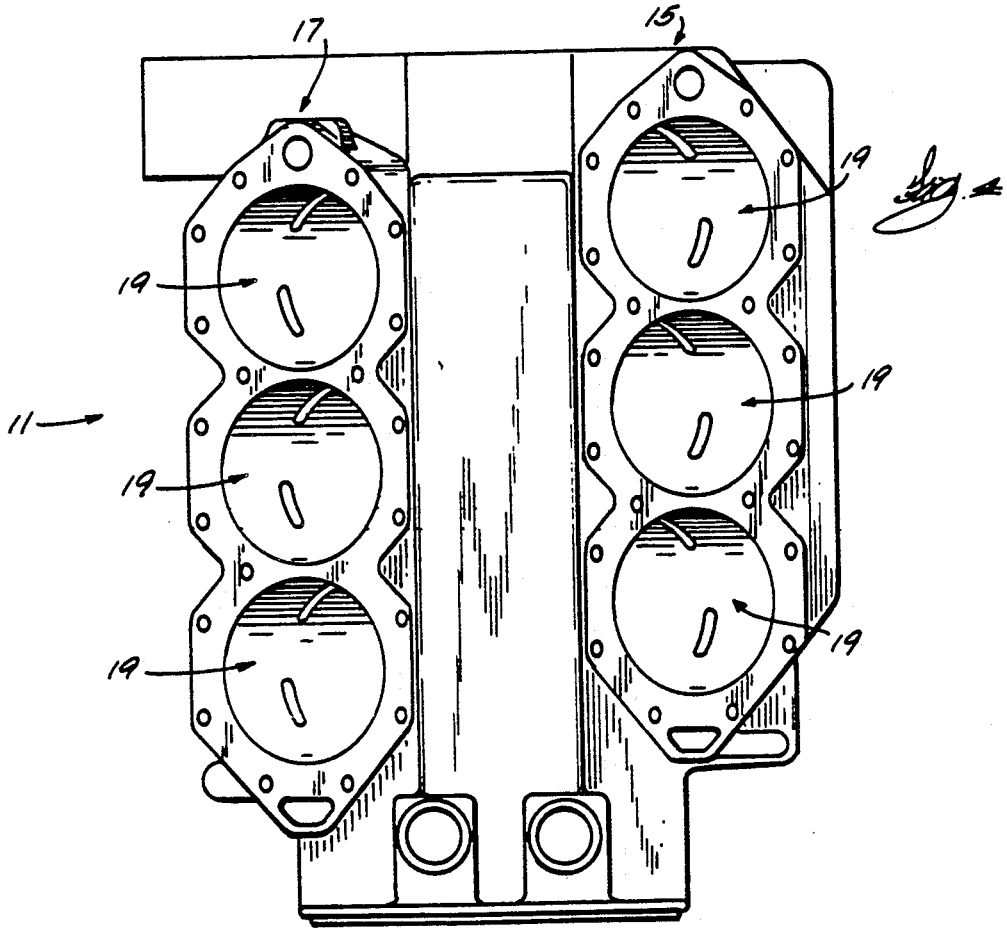
FIG. 4 is a view taken along line 4—4 in FIG. 3.

Shown in the drawings is a V-block internal combustion engine 11 of the two-stroke type. The engine comprises a V-type block 13 including left and right cylinder banks 15 and 17 each including any suitable number of cylinders 19. In the disclosed construction, each of the cylinder banks 15 and 17 includes (see FIG. 4) three aligned cylinders 19. Thus, the disclosed and preferred engine includes six cylinders 19. Each cylinder 19 has therein (see FIGS. 5 and 6) a cylinder liner 21.

Figure 2:
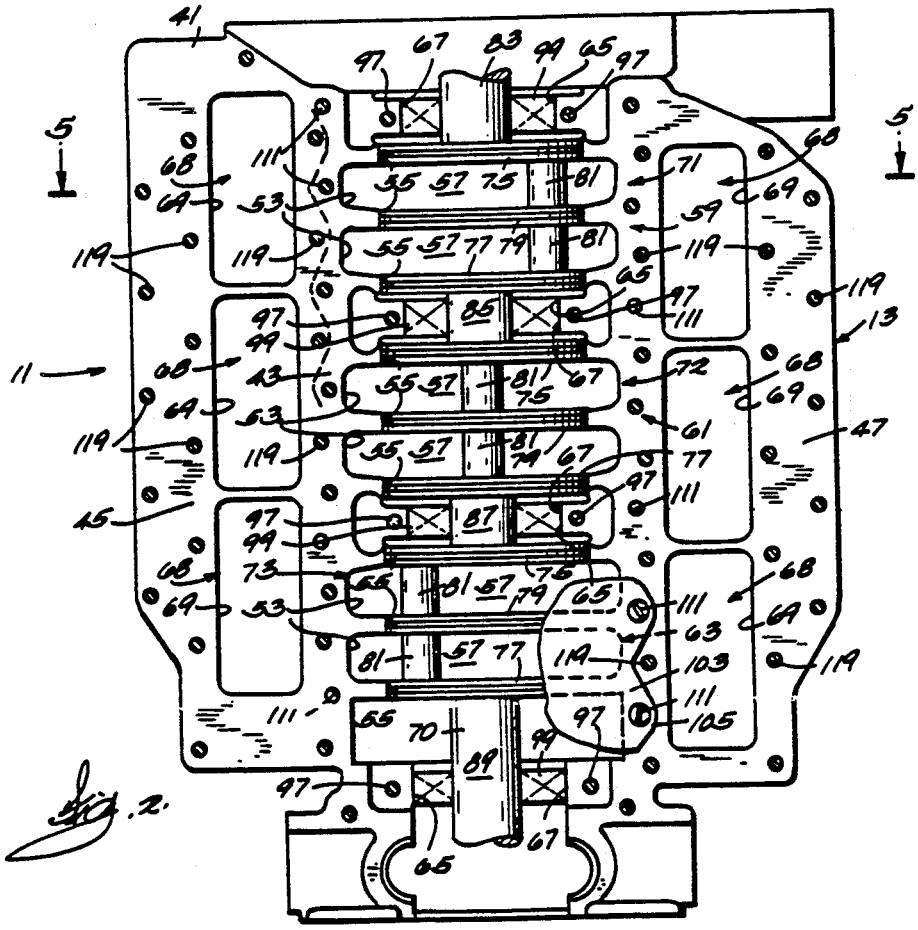
FIG. 2 is a view taken along line 2—2 in FIG. 1 and including a fragment of a crankcase cover.
Figure 3:
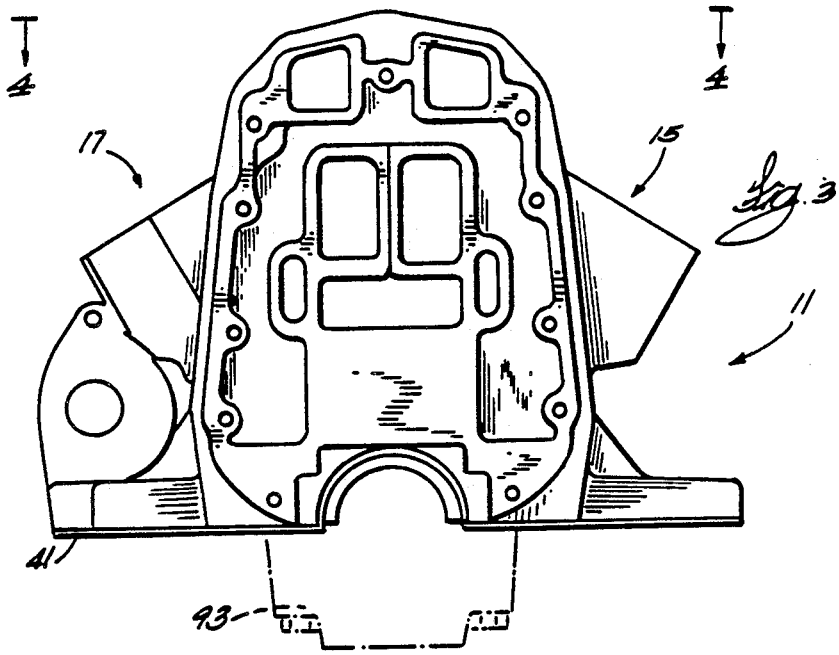
FIG. 3 is a bottom plan view of the engine block.

More specifically, the engine block 13 includes a flat or planar exterior mounting surface 41 including (see FIG. 2) a central portion 43 and left and right side or manifold mounting portions 45 and 47 respectively located on the opposite sides of the central portion 43. The central portion 43 includes a plurality of crankcase-defining cavities 53, one for each of the cylinders 19. Each crankcase-defining cavity 53 is defined in part by a pair of semi-cylindrical walls 55. The crankcase-defining cavities 53 cooperate with a crankcase cover and with a series of crankshaft discs, both still to be described in greater detail, to provide a series of six separate and individual crankcases 57. The crankcases 57 are arranged in pairs such that, in axial order (from top to bottom in FIG. 2), the first and second crankcases 57 constitute a first or outer crankcase pair 59, the third and fourth crankcases 57 constitute a second or central crankcase pair 61, and the fifth and sixth crankcases 57 constitute a third or outer crankcase pair 63. Thus, there are two outer crankcase pairs 59 and 63 and one central crankcase pair 61.

The central portion 43 of the mounting surface 41 also includes (see FIG. 2) a plurality of crankshaft-bearing recesses 65 defined in part by respective semi-cylindrical walls 67. A bearing recess 65 is located axially outwardly of each of the outer pairs 59 and 63 of crankcases 57, and a bearing recess 65 is located in each of the two spaces between the three pairs 59, 61 and 63 of crankcases 57.

The engine block 13 also includes (see FIGS. 2 and 5) combustion air passages 68 which extend from respective crankcases 57 to respective combustion air ports 69 in the manifold mounting surface portions 45 and 47. In the disclosed and preferred construction, each of the manifold surface portions 45 and 47 includes three combustion air ports 69 (one for each crankcase 57 associated with one of the three cylinders 19 in the associated bank 15 or 17).

As already indicated, the engine 11 also comprises (see FIG. 2) a crankshaft 70. The crankshaft 70 includes three series 71, 72 and 73 of crank-discs 75, 77 and 79 which are spaced from each other, which are cylindrical in shape, which have enlarged, cylindrical outer surfaces and which are connected by a series of crankpins 81 and by a series of cylindrical bearing portions 83, 85, 87 and 89. Each series 71, 72 or 73 of crank-discs includes opposite end crank-discs 75 and 77 and an intermediate crank-disc 79. Each crank-disc 75, 77 or 79 is located in generally coplanar relation (in a plane generally perpendicular to the longitudinal axis of the crankshaft 70) to an associated wall 55. The bearing portions 83 and 89 are located axially outwardly of the series 71 and 73 of crank-discs, the bearing portion 85 is located between the series 71 and 72 of crank-discs, and the bearing portion 87 is located between the series 72 and 73 of crank-discs.

Each of the pairs 59, 61 and 63 of crankcases 57 is essentially identically constructed and is also defined, in part, by an associated series 71, 72 or 73 of crank-discs. More specifically, one crankcase 57 in each of the pairs 59, 61 and 63 is defined between the end disc 75 and the intermediate disc 79 and the other crankcase 57 in each pair is defined between the intermediate disc 79 and the other end disc 77.

Means are provided for rotatably supporting the crankshaft 70 by the engine block 13. While other arrangements can be employed, in the disclosed construction, such means comprises the walls or bearing surfaces 67 in the crankshaft-bearing recesses 65 in the engine block 13, the bearing portions 83, 85, 87 and 89 on the crankshaft 70, and bearing blocks 93 (FIGS. 1 and 6) fixed to the engine block 13. The bearing blocks 93 include respective semi-cylindrical bearing surfaces 95 and each is fixed to the engine block 13 in opposing relation to the semi-cylindrical bearing surface 67 of an associated bearing cavity 65 and in supporting relation to an associated crankshaft bearing portion 83, 85, 87 or 89. While other constructions can be employed, in the disclosed construction, suitable bolts 97 (FIGS. 1 and 2) extend through the bearing blocks 93 and are threaded into the engine block 13 to fix the bearing blocks 93 to the central portion 43 of the engine block surface 41. Each bearing block 93 and the associated bearing surface 67 support suitable bearing means 99 which in turn supports the associated bearing portion 83, 85, 87 or 89 of the crankshaft 70.

As already indicated, the engine 11 also comprises (see FIGS. 1, 2, 5 and 6) a crankcase cover or covering member 103 which covers the central portion of the crankshaft 70 and the bearing blocks 93 and which includes a peripheral margin 105 (FIGS. 1 and 2) adapted to engage and mate with the engine block surface 41. Formed centrally in the crankcase cover 103, inwardly of the peripheral margin 105, are a series of crankcase-defining cavities or recesses 107 (FIG. 6) which cooperate with the crank-discs 75, 77 and 79 and with the crankcase-defining cavities 53 in the engine block 13 to define the crankcases 57. Each crankcase-defining cavity 107 is defined in part by a pair of semi-cylindrical surfaces 109 cooperating with the associated crank-discs to define the respective crankcase 57. Preferably, suitable seals 110 are provided between the discs 75, 77 and 79 and the semi-cylindrical walls 55 and 109 of the crankcase-defining cavities 53 of the engine block 13 and of the crankcase-defining cavities 107 of the crankcase cover 103.

Means are provided for fixing the crankcase cover 103 to the engine block surface 41. While other constructions can be employed, in the disclosed construction, a series of bolts 111 (FIG. 2) extend through the peripheral margin 105 of the cover 103 and are threaded into the engine block surface 41 so as to locate the cover 103 with the semi-cylindrical surfaces 109 thereof in coplanar alignment with the semi-cylindrical surfaces 55 of the engine block 13 and in covering relation to the bearing blocks 93.

Figure 5:
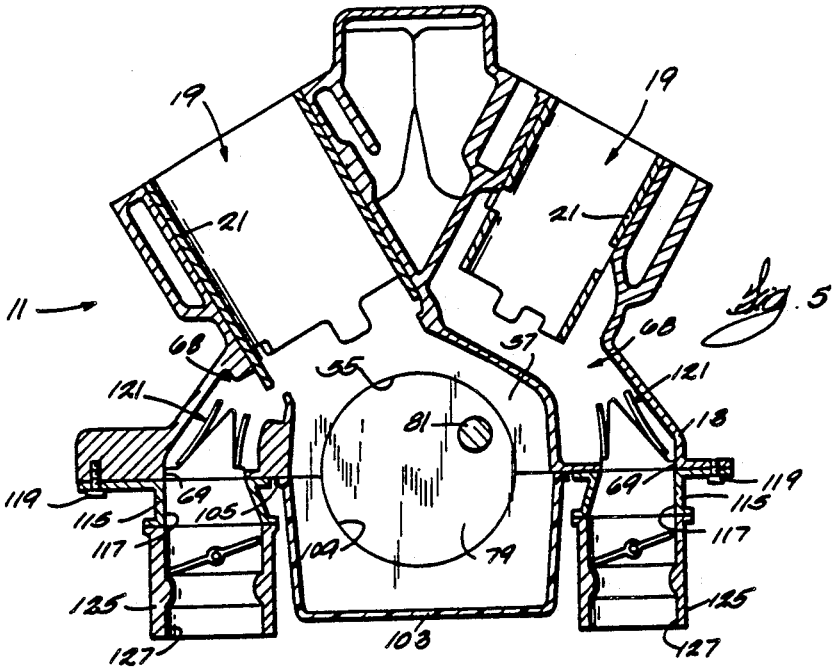
FIG. 5 is a view taken along line 5—5 in FIG. 2 and with parts omitted.
Figure 6:
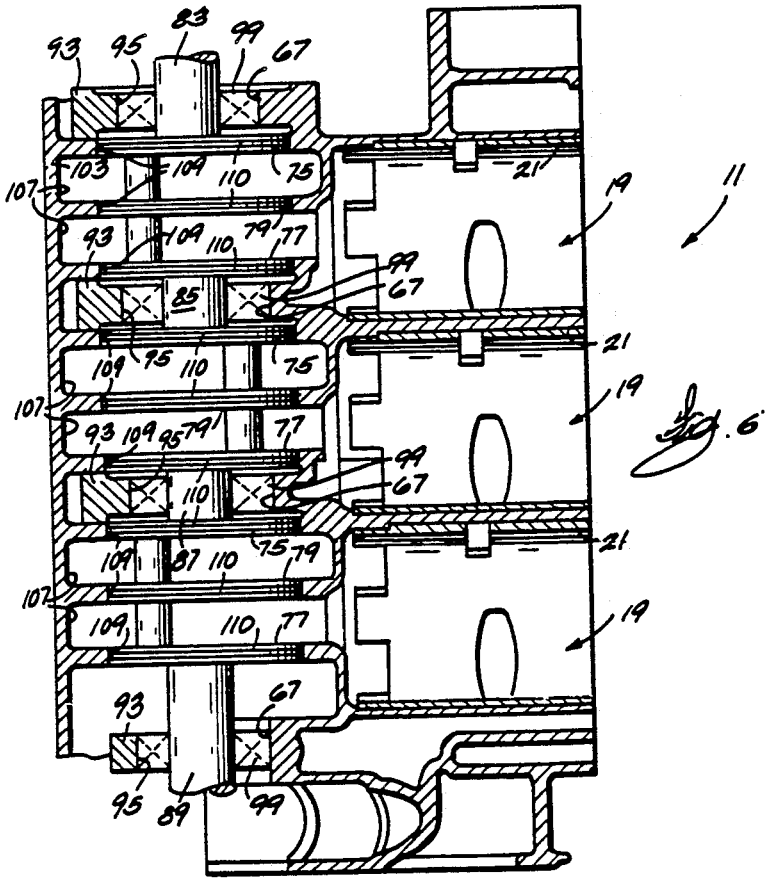
FIG. 6 is a fragmentary view taken along line 6—6 in FIG. 1.

The engine 11 also comprises means connected to the manifold mounting surface portions 45 and 47 for supplying combustion air to the combustion air passages 68. While various suitable means can be employed, in the preferred embodiment, the engine 11 comprises, in association with each of the manifold mounting surface portions 45 and 47, an intake manifold 115 (FIGS. 1 and 5) including three combustion air passages 117 (FIG. 5). The air intake manifolds 115 are suitably connected to their respective manifold mounting surfaces 45 and 47 by a series of bolts 119 such that the combustion air passages 117 in the manifolds 115 mate with the combustion air ports 69 in the manifold mounting surfaces 45 and 47. In the illustrated construction, each intake manifold 115 has attached thereto three reed boxes 121 (FIG. 5). It should be understood that other means can be employed for supporting the reed boxes 121. Each reed box 121 communicates with a respective air passage 117 in the associated manifold 115 and extends into a respective combustion air port 69 in the engine block 13.

Connected to the manifolds 115 are a series of carburetors 125 (FIGS. 1 and 5), one for each combustion air passage 117 in the manifolds 115. Thus, in the preferred and disclosed construction, six carburetors 125 are employed, each carburetor 125 including a combustion air passage 127.

Suitable means are provided for fixing the carburetors 125 to the manifolds 115 with the carburetor combustion air passages 127 in communication with the combustion air passages 117 in the manifolds 115. While other constructions could be employed, in the illustrated construction, such means comprises a series of screws or bolts 129.

An advantage of the disclosed engine construction is the fact that the intake manifolds 115 are mounted on the same planar surface 41 on which the crankcase cover 103 is mounted. This construction is to be distinguished from known prior art constructions in which the crankcase cover is mounted on the engine block and the intake manifolds are mounted on the crankcase cover, so that the crankcase cover is located between the intake manifolds and the engine block. The advantage of having the intake manifolds 115 mounted on the same surface as the crankcase cover 103 is that the intake manifolds 115 (and therefore the carburetors 125) are not located as far forwardly as they would be if the intake manifolds 115 were mounted on the crankcase cover 103. As a result, the overall engine does not extend as far forwardly (downwardly in FIG. 1) of the crankshaft as in known prior art constructions.

Figure 7:
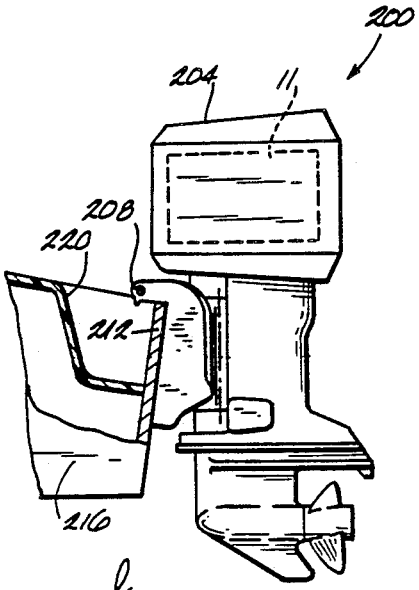
FIG. 7 is a side elevational view of an outboard motor which includes the engine shown in FIGS. 1-6 and which is located in its drive position.
Figure 8:
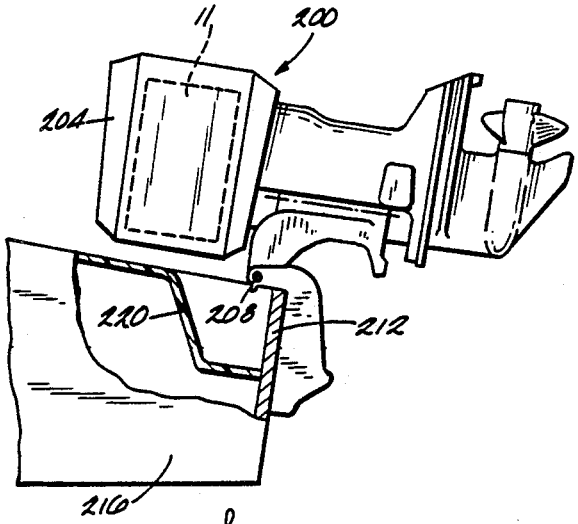
FIG. 8 is a view similar to FIG. 7 showing the outboard motor in its full upward tilt position.

An outboard motor 200 including the engine 11, a surrounding cowling 204, and a tilt axis 208 is illustrated in FIGS. 7 and 8. The outboard motor 200 is shown mounted on the transom 212 of a boat 216 including a motor well 220. The outboard motor 200 is shown in its drive position in FIG. 7 and is shown in its full upward tilt position in FIG. 8. A prior art outboard motor is shown in its drive position in FIG. 9 and in its full upward tilt position in FIG. 10.

Figure 9:
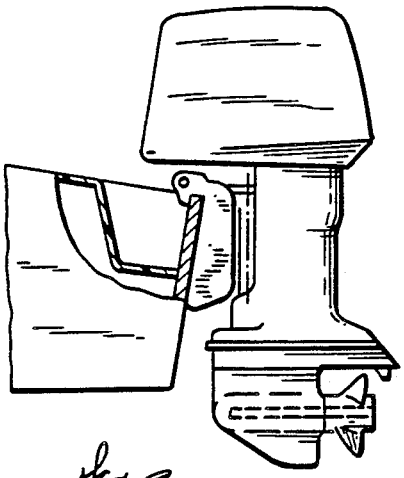
Fig. 9 PRIOR ART
FIG. 9 is a side elevational view of a prior art outboard motor located in its drive position.
Figure 10:
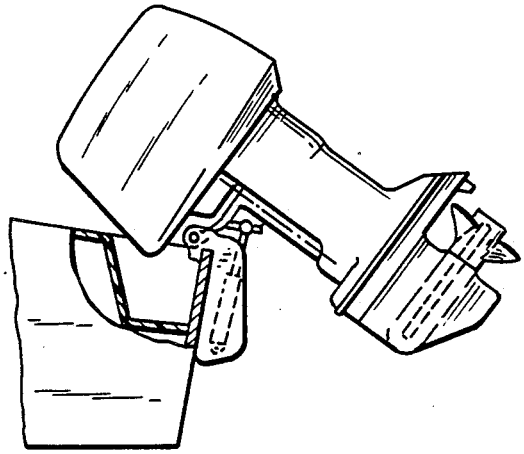
Fig. 10 PRIOR ART
FIG. 10 is a view similar to FIG. 9 showing the prior art outboard motor in its full upward tilt position.

As shown in FIGS. 7 and 8, the engine 11 and the cowling 204 of the outboard motor 200 do not extend as far forwardly of the tilt axis 208 as with known prior art engine constructions (see FIG. 9). This allows the outboard motor 200 to be tilted upwardly (FIG. 8) to a greater extent than with known prior art constructions (as shown in FIG. 10) before the cowling 204 hits the motor well 220. This reduces damage to boats and/or outboard motors due to operator error in tilting motors too far upwardly.

Various of the features of the invention are set forth in the following claims.

We claim:

1. A two-stroke internal combustion engine comprising an engine block including an exterior planar surface portion having therein a pair of spaced bearing surfaces and a crankcase-defining cavity which includes a pair of spaced semi-cylindrical surfaces, a crankshaft including a pair of spaced bearing portions and a central part which is located between said bearing portions and which includes a pair of spaced and enlarged cylindrical surfaces, a pair of bearing blocks respectively including bearing surfaces, means fixing said bearing blocks to said exterior planar surface portion with each of said crankshaft bearing portions retained between a respective one of said bearing surfaces of said engine block and a respective one of said bearing surfaces of said bearing blocks and with each of said crankshaft cylindrical surfaces in coplanar relation to a respective one of said semi-cylindrical surfaces of said engine block, a crankcase cover including a mounting surface having therein a crankcase-defining cavity including a pair of spaced semi-cylindrical surfaces, and means fixedly connecting said mounting surface of said crankcase cover to said exterior planar surface portion of said engine block with each of said semi-cylindrical surfaces of said crankcase cover in generally coplanar relation to a respective one of said semi-cylindrical surfaces of said engine block.

2. An internal combustion engine in accordance with claim 1 wherein said crankcase cover also encloses said bearing blocks and said central part of said crankshaft.

3. An internal combustion engine in accordance with claim 1 wherein said crankcase cover is fabricated of plastic.

4. An internal combustion engine in accordance with claim 1 wherein said exterior surface portion is planar.

5. A two-stroke internal combustion engine comprising an engine block including a first exterior surface portion, a second exterior surface portion spaced from said first portion, extending in coplanar relation to said first exterior surface portion, and having therein a crankcase-defining cavity, a cylinder communicating with said crankcase-defining cavity, and a combustion air passage extending from said first exterior surface portion to said crankcase-defining cavity, and means connected to said first exterior surface portion for supplying combustion air to said combustion air passage.

6. An internal combustion engine in accordance with claim 5 wherein said means includes an intake manifold including a combustion air passage, means fixedly connecting said intake manifold to said first exterior surface portion of said engine block and with said manifold combustion air passage in alignment with said combustion air passage in said engine block, a carburetor having therein a combustion air passage, and means fixedly connecting said carburetor to said manifold with said carburetor combustion air passage in alignment with said intake manifold combustion air passage.

7. An engine as set forth in claim 5 and further comprising a crankcase cover mounted on said second exterior surface portion of said engine block.

8. A two-stroke internal combustion engine comprising an engine block including a first exterior surface portion, a second exterior surface portion spaced from said first portion and having therein a pair of spaced bearing surfaces and a crankcase-defining cavity which includes a pair of spaced semi-cylindrical surfaces, and a combustion air passage extending from said first exterior surface portion to said crankcase-defining cavity, a crankshaft including a pair of spaced bearing portions and a central part located between said bearing portions and including a pair of spaced and enlarged cylindrical surfaces, a pair of bearing blocks respectively including bearing surfaces, means fixing said bearing blocks to said second exterior surface portion with each of said crankshaft bearing portions retained between a respective one of said bearing surfaces of said engine block and a respective one of said bearing surfaces of said bearing blocks and with each of said enlarged crankshaft cylindrical surfaces in coplanar relation to a respective one of said semi cylindrical surfaces of said engine block, a crankcase cover including a mounting surface having therein a crankcase-defining cavity including a pair of spaced semi-cylindrical surfaces, means fixedly connecting said mounting surface of said crankcase cover to said second exterior surface portion of said engine block with each of said semi-cylindrical surfaces thereof in generally coplanar relation to a respective one of said semi-cylindrical surfaces of said engine block and so as to cover said bearing blocks and said central part of said crankshaft, and means connected to said first exterior surface portion for supplying combustion air to said combustion air passage.

9. An internal combustion engine in accordance with claim 7 wherein said crankcase cover is fabricated of plastic.

10. An internal combustion engine in accordance with claim 9 wherein said first and second exterior surface portions are coplanar.

11. An internal combustion engine in accordance with claim 7 wherein said means for supplying combustion air includes an intake manifold including a combustion air passage, means fixedly connecting said intake manifold to said first exterior surface portion of said engine block and with said manifold combustion air passage in alignment with said combustion air passage in said engine block, a carburetor having therein a combustion air passage, and means fixedly connecting said carburetor to said manifold with said carburetor combustion air passage in alignment with said intake manifold combustion air passage.

12. A two-stroke internal combustion engine comprising a V-type engine block including an exterior surface having spaced first and second exterior surface portions and a third exterior surface portion which is planar and which is located between said first and second surface portions and which has therein a pair of spaced bearing surfaces, a plurality of first crankcase-defining cavities located between said spaced bearing surfaces and each including a pair of spaced semi-cylindrical surfaces, and a plurality of second crankcase-defining cavities located between said spaced bearing surfaces and each including a pair of spaced semi-cylindrical surfaces, a first cylinder bank including a plurality of first cylinders each communicating with a respective one of said first crankcase-defining cavities, a second cylinder bank which is angularly spaced from said first cylinder bank and which includes a plurality of second cylinders each communicating with a respective one of said second crankcase-defining cavities, a crankshaft including a pair of spaced bearing portions and a plurality of central parts which are located between said bearing portions and each of which includes a pair of spaced and enlarged cylindrical surfaces, a pair of bearing blocks respectively including bearing surfaces, means fixing said bearing blocks to said third exterior surface portion of said engine block with each of said crankshaft bearing portions retained between a respective one of said bearing surfaces of said engine block and a respective one of said bearing surfaces of said bearing blocks and with each of said crankshaft cylindrical surfaces in coplanar relation to a respective one of said semi-cylindrical surfaces of said engine block, a crankcase cover including a mounting surface having therein a plurality of crankcase-defining cavities each including a pair of spaced semi-cylindrical surfaces, and means fixedly connecting said mounting surface of said crankcase cover to said third exterior surface portion of said engine block with each of said semi-cylindrical surfaces of said crankcase cover in generally coplanar relation to a respective one of said semi-cylindrical surfaces of said engine block.

13. An engine as set forth in claim 12 wherein said first, second and third exterior surface portions of said engine block are coplanar.

14. A two-stroke internal combustion engine comprising a V-type engine block including spaced first and second exterior surface portions, a third exterior surface portion which is located between said first and second surface portions and which has therein a plurality of first crankcase-defining cavities and a plurality of second crankcase-defining cavities, a first cylinder bank including a plurality of first cylinders each communicating with a respective one of said first crankcase-defining cavities, a second cylinder bank which is angularly spaced from said first cylinder bank and which includes a plurality of second cylinders each communicating with a respective one of said second crankcase-defining cavities, a plurality of first combustion air passages each extending from said first exterior surface portion to a respective one of said first crankcase-defining cavities, and a plurality of second combustion air passages each extending from said second exterior surface portion to a respective one of said second crankcase-defining cavities, and means connected to said first and second exterior surface portions for supplying combustion air to said first and second combustion air passages.

15. An engine as set forth in claim 11 and further comprising a crankcase cover mounted on said third exterior surface portion of said engine block.

16. An engine as set forth in claim 15 wherein said first, second and third exterior surface portions of said engine block are coplanar.

17. A two-stroke internal combustion engine comprising a V-type engine block including an exterior surface having spaced first and second exterior surface portions and a third exterior surface portion which is located between said first and second surface portions and which has therein first and second crankcase-defining cavities, a first cylinder bank including a first cylinder communicating with said first crankcase-defining cavity, a second cylinder bank which is angularly spaced from said first cylinder bank and which includes a second cylinder communicating with said second crankcase-defining cavity, a first combustion air passage extending from said first exterior surface portion for supplying combustion air to said first cylinder, means connected to said first exterior surface portion for supplying combustion air to said first combustion air passage, a second combustion air passage extending from said second exterior surface portion for supplying combustion air to said second cylinder, and means connected to said second exterior surface portion for supplying combustion air to said second combustion air passage.

18. A two-stroke internal combustion engine comprising a V-type engine block including an exterior surface having spaced first and second exterior surface portions and a third exterior surface portion having therein first and second crankcase-defining cavities, a first cylinder bank including a first cylinder communicating with said first crankcase-defining cavity, a second cylinder bank which is angularly spaced from said first cylinder bank and which includes a second cylinder communicating with said second crankcase-defining cavity, a first combustion air passage extending from said first exterior surface portion for supplying combustion air to said first cylinder, means connected to said first exterior surface portion for supplying combustion air to said first combustion air passage, a second combustion air passage extending from said second exterior surface portion for supplying combustion air to said second cylinder, means connected to said second exterior surface portion for supplying combustion air to said second combustion air passage, and a crankcase cover including a rearward part which is mounted on said third surface portion of said engine block and which has therein first and second crankcase-defining cavities respectively aligned with said first and second crankcase-defining cavities in said third surface portion of said engine block, and a forward part located forwardly of said first and second surface portions of said engine block.

19. An internal combustion engine comprising a V-type engine block including an exterior surface having spaced first and second exterior surface portions and a third exterior surface portion which is located between said first and second surface portions and which has therein a crankcase-defining cavity, a first cylinder bank including a first cylinder, a second cylinder bank which is angularly spaced from said first cylinder bank and which includes a second cylinder, a first combustion air passage extending from said first exterior surface portion for supplying combustion air to said first cylinder, means connected to said first exterior surface portion for supplying combustion air to said first combustion air passage, a second combustion air passage extending from said second exterior surface portion for supplying combustion air to said second cylinder, and means connected to said second exterior surface portion for supplying combustion air to said second combustion air passage.

20. An internal combustion engine comprising a V-type engine block including an exterior surface having spaced first and second exterior surface portions and a third exterior surface portion having therein a crankcase-defining cavity, a first cylinder bank including a first cylinder, a second cylinder bank which is angularly spaced from said first cylinder bank and which includes a second cylinder, a first combustion air passage extending from said first exterior surface portion for supplying combustion air to said first cylinder, means connected to said first exterior surface portion for supplying combustion air to said first combustion air passage, a second combustion air passage extending from said second exterior surface portion for supplying combustion air to said second cylinder, means connected to said second exterior surface portion for supplying combustion air to said second combustion air passage, and a crankcase cover including a rearward part which is mounted on said third surface portion of said engine block and which has therein a crankcase-defining cavity aligned with said crankcase-defining cavity in said third surface portion of said engine block, and a forward part located forwardly of said first and second surface portions of said engine block.

* * * * *